United States Patent [19]

Onoue et al.

[11] 4,314,440

[45] Feb. 9, 1982

[54] DUST REMOVING MECHANISM IN OPEN-END SPINNING FRAME

[75] Inventors: Keiji Onoue, Kariya; Takashi Katoh, Toyota; Yoshiaki Yoshida, Ohbu; Kazuo Seiki, Kariya, all of Japan

[73] Assignee: Kabushiki Kaisha Toyoda Jidoshokki Seisakusho, Kariya, Japan

[21] Appl. No.: 138,519

[22] Filed: Apr. 9, 1980

[30] Foreign Application Priority Data

Apr. 11, 1979 [JP] Japan ..... 54-42964

[51] Int. Cl.[3] ..... D01H 7/888; D01H 11/00

[52] U.S. Cl. ..... 57/301; 57/58.95; 57/304

[58] Field of Search ..... 57/58.89–58.95, 57/301, 302, 304

[56] References Cited

U.S. PATENT DOCUMENTS 3,892,063 7/1975 Doudlebsky et al. ..... 57/301
3,986,327 10/1976 Kobayashi ..... 57/301
4,009,562 3/1977 Stalder ..... 57/301
4,036,002 7/1977 Kobayashi ..... 57/58.89
4,204,393 5/1980 Miyazaki et al. ..... 57/301

*Primary Examiner*—John Petrakes
*Attorney, Agent, or Firm*—Wenderoth, Lind & Ponack

[57] ABSTRACT

An open-end spinning unit has a housing having a cylindrical space, with a complementary cylindrical fiber-opening roller disposed in that space which communicates with a dust removing chamber having a dust separating zone and a dust discharge promoting zone, said zones being connected together through an intermediate passage positioned on the downstream side of a dust removing opening communicating with said space, a wall portion of the casing defining a downstream side of the dust separating zone being comprized by an inclined wall which faces an end portion of a partition separating said zones, the partition having an end wall which is inclined with respect to the vertical direction at an angle equal to or smaller than an angle of inclination of the inclined wall.

10 Claims, 7 Drawing Figures

FIG. 5
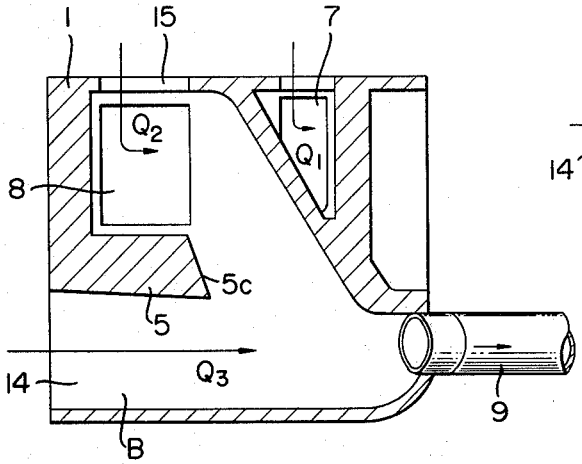
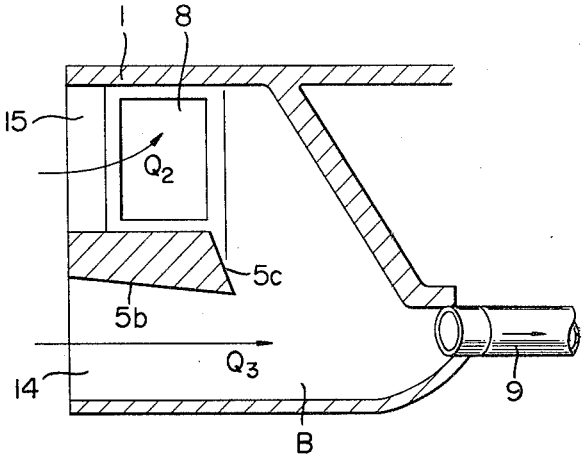
FIG. 6
FIG. 7
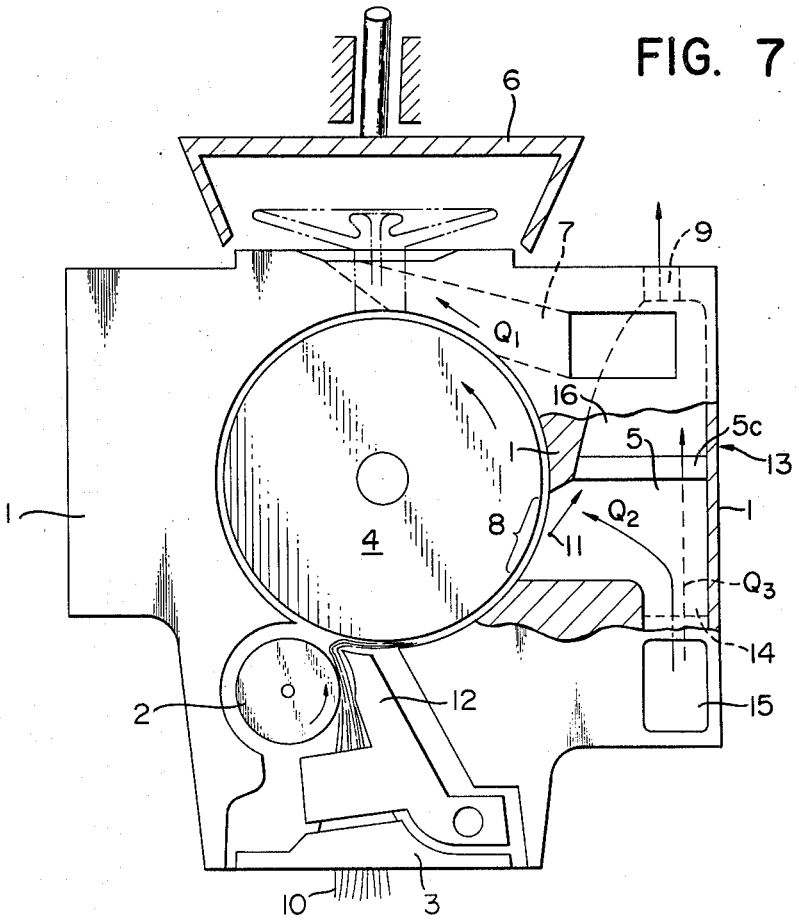

DUST REMOVING MECHANISM IN OPEN-END SPINNING FRAME

BACKGROUND OF THE INVENTION

1. Cross Reference to the Invention

This invention relates to co-pending U.S. patent application Ser. No. 971,499 "Dust Removing Mechanism in Open-End Spinning Frame" filed on Dec. 20, 1978 by Tsutomu Miyazaki et al, now U.S. Pat. No. 4,204,393, and assigned to the same assignee as the present application.

2. Field of the Invention

This invention relates to a dust removing mechanism in an open-end spinning frame and more particularly to improvements in a dust removing mechanism of the type wherein centrifugal force acting on dust entrained in opened fibers causes the dust to be removed from the opened fibers through a dust removing opening provided in a casing for an opening roller while a silver is being opened into the individually opened fibers and delivered by the opening roller.

3. Description of the Prior Art

Where impurities and foreign matter such as dust, neps, leaf pieces, seed pieces and chemical adhering substances (inclusively referred to as "dust" hereinafter) are entrained in material fibers, there is a tendency that the operation for collecting the fibers in a twisting region and spinning them into a twisted yarn becomes unstable, resulting in poor yarn quality. In order to avoid this tendency, various designs of dust removing mechanisms have been proposed, in which a dust removing opening is formed at a part of a fiber opening region, wherein a fiber opening roller is disposed upstream of the twisting region, and dust is caused to fly off through this dust removing opening by the centrifugal force acting thereon. However, satisfactory results could not be obtained by these designs.

Since the ejection of dust through the dust removing opening depends on the centrifugal force acting thereon, the fibers per se also may be ejected along with the dust by the action of the centrifugal force on the fibers. As a means for preventing the ejection of the fibers, a method has been proposed in which an auxiliary air stream is produced to flow into the dust removing opening. Dust of relatively large mass can fly off from the dust separating zone against the opposing force of this auxiliary air stream, but the fibers having a relatively light mass are prevented from flying off from the dust separating zone by the auxiliary air stream entering thereinto and are delivered to the twisting region by the opening roller. In this method, however, the dust-removing effect is remarkably influenced by the intensity of the auxiliary air stream and the direction of flow thereof, and therefore delicate adjustment of the air stream is required at the dust removing opening. Such method is disclosed in U.S. Pat. Nos. 3,986,327 and 4,036,002.

Further, a method has been proposed, in which to promptly remove the dust ejected through the dust removing opening and thereby prevent the dust from remaining in a region adjacent to the dust removing opening, in addition to the auxiliary air stream, a dust discharging air stream is provided so as to flow into a dust discharging zone adjacent to the dust separating zone and to be introduced therefrom into the dust separating zone. In this method, adjustment of the intensity relation between the dust discharge air stream and the auxiliary air stream in the dust separating zone is very complex and difficult. More specifically, in order to promptly discharge the dust ejected through the dust removing opening and separating zone, it is necessary to produce the dust discharging air stream at a position close to the separating zone and also to increase the intensity of such a dust discharging air stream. However, if the intensity of the dust discharging air stream is too strong, the dust discharging air stream will adversely influence the separating zone, thus disturbing the smooth flow of the auxiliary air stream, and also the phenomenon will occur that the fibers are also sucked into and discharged through the dust separating opening. Such an undesirable phenomenon can be avoided by reducing the intensity of the dust discharging air stream, but in that event depositing and adhesion of the dust and fine fibers onto the walls of the separating zone and dust discharging zone will then occur. When the dust adheres to the walls, leaf pieces and the like act as nuclei and fine fibers adhere to and gather around the nuclei. Thus, the dust gradually accumulates on the walls. When the degree of accumulation of dust on the walls exceeds a certain extent, it will be scattered in the form of large masses by the action of the air streams, and these masses will come under the influence of the auxiliary air stream and will be directed toward the dust removing opening. As a result, there will occur the most undesirable phenomenon that these dust masses are blown back into the dust removing opening. This actually occurs when adjustment of the air streams is not carried out appropriately. Such method is disclosed in U.S. Pat. Nos. 3,892,063 and 4,009,562.

It is therefore understood that, in the dust removing method for the open-end spinning frame, in which the auxiliary air stream for catching fibers from the dust removing opening and the dust discharging air stream for discharging the dust are utilized, it is most preferable that the auxiliary air stream be applied in such a way that the ejection of dust from the dust removing opening is allowed, but the ejection of fibers from the dust removing opening is prevented, and that the influence of the dust discharging air stream on the dust separating zone is reduced to a minimum level while at the same time the dust discharging air stream is capable of flowing strongly through the dust discharging zone.

The invention in the afore-mentioned co-pending application is directed toward realizing the said preferable conditions in the dust removing method. More specifically, said co-pending application discloses a dust removing mechanism for an open-end spinning frame, in which a partition plate is disposed in such a manner as to define a dust separating zone communicating with atmospheric air to generate an auxiliary air stream directed to a dust removing opening, and a dust discharge promoting zone having a suction opening and a confronting air intake opening for generating a linear stream of air for dust discharge; a passage communicating the dust separating zone with the dust discharge promoting zone is provided as a transfer passage for the dust ejected from the dust removing opening, downstream of the dust removing opening with respect to the rotation direction of an opening roller; and the wall of the dust separating zone on the downstream side is so inclined that the dust flying off through the dust removing opening bounces back to the communicating passage and is finally introduced into the dust discharging zone. In this dust removing mechanism, the partition plate defining each of the dust separating zone and dust discharge promoting zone regulates the flow pattern of the dust discharging air stream and prevents any serious influence of the dust discharging air stream on the dust removing opening, and dust ejected through the dust removing opening is caused to bounce off the inclined walls due to the kinetic energy of the flying dust and is positively discharged from the suction opening into a dust collecting zone, while being carried by the dust discharging air stream in the dust discharge promoting zone.

Although the dust removing mechanism disclosed in said co-pending application provides a higher rate of dust removal than that attained by any of the dust removing mechanisms shown in U.S. Pat. Nos. 3,986,327, 4,036,002, 3,892,063 and 4,009,562, it still involves the disadvantage that the wedge-shaped partition plate can cause some of the dust bouncing off the partition plate to be moved back into the dust removing opening.

It is therefore a principal object of this invention to provide a dust removing mechanism, which eliminates the disadvantage of the invention in the afore-mentioned co-pending application without detriment to the advantages thereof.

SUMMARY OF THE INVENTION

In brief, a dust removing mechanism according to this invention is generally incorporated in a spinning unit comprising a housing having a cylindrical space, and a complementary cylindrical opening roller disposed in that space. The mechanism comprises a dust removing chamber provided in the casing and having a dust removing opening facing the cylindrical space, and a partition plate disposed in the dust removing chamber to partition it into a dust separating zone, which is in communication with both the dust removing opening and the atmosphere to cause an auxiliary air stream flowing into the dust removing opening to be generated, and a dust discharge promoting zone, which is in communication with the atmosphere to produce a linear, dust discharging air stream. These zones are connected together through an intermediate passage positioned on the downstream side of the dust removing opening with respect to the direction of rotation of the opening roller.

A wall portion of the casing defining the downstream side of the dust separating zone is formed with an inclined wall, and an end portion of the partition plate facing the intermediate passage is also formed in an inclined wall. An angle of inclination of the casing's inclined wall with respect to the vertical direction is equal to or larger than an angle of inclination of the partition plate's inclined wall with respect to the vertical direction so that the dust impinging against the casing's inclined wall can bounce into the intermediate passage and then can be introduced into the dust discharge promoting zone.

Also, according to this invention, a line from which the inclination of the partition plate starts is defined in specific positional relation with a line from which the inclination of the casing's inclined wall starts so that the dust impinging against the casing's inclined wall at the inclination start line or at a position adjacent thereto can be decidedly directed toward the partition plate's inclined wall.

BRIEF DESCRIPTION OF THE DRAWINGS

This invention will be more readily understood from the following description of the preferred embodiments thereof shown, by way of example only, in the accompanying drawings, wherein:

FIGS. 5 and 6 are views corresponding to that of FIG. 3, showing different modifications of this invention; and FIG. 7 is a view corresponding to that of FIG. 1, showing a still different modification of this invention.

DESCRIPTION OF THE PREFERRED EMBODIMENTS

Figure 1:
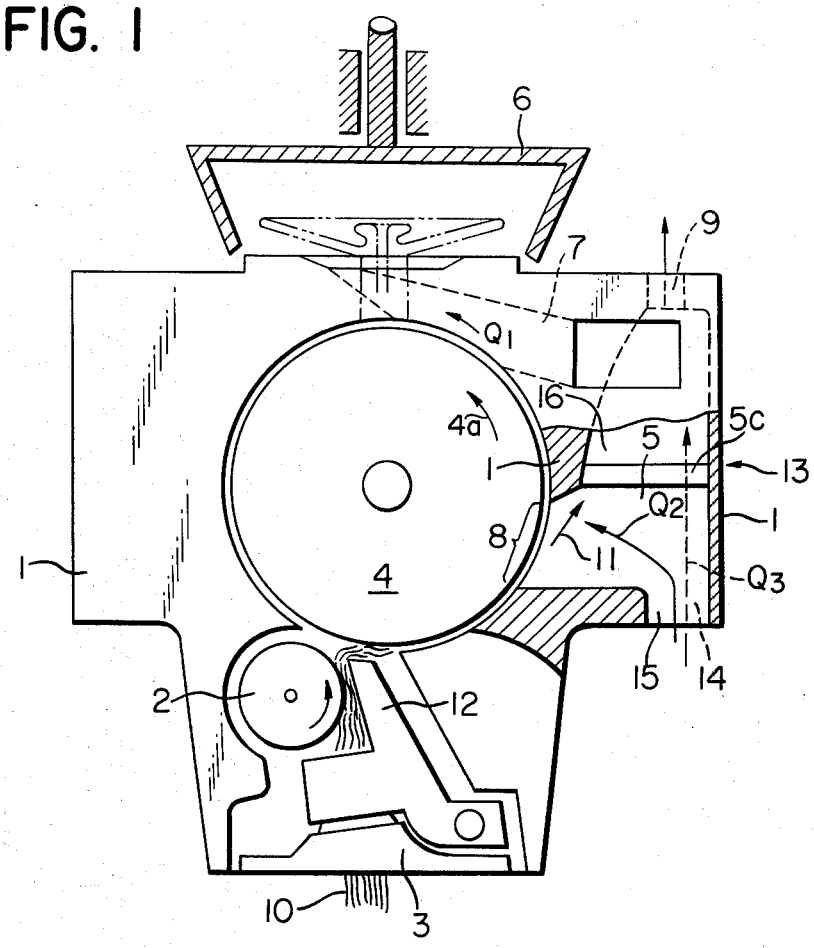
FIG. 1 is a plan view showing, partly in section, the entire structure of an open-end spinning unit, in which a dust removing mechanism according to this invention is incorporated.

Referring to FIG. 1, there is shown one of the spinning units for an open-end spinning frame, which is provided with a dust removing mechanism constructed in accordance with the principles of this invention. As is well known, a material sliver 10 fed through a collector 3 is gradually delivered into an adjacent fiber opening region while being gripped between a feed roller 2 and a pressure plate 12. In the opening region, the fiber sliver 10 is opened into individual fibers by an opening roller 4, which rotates at a high speed to perform fiber opening and delivering functions between an opening member (not shown) attached to the cylindrical surface of the roller 4 and the inner cylindrical wall surface of a casing 1 for the roller 4. The individual fibers are delivered in the direction of an arrow 4*a* while adhering to the opening member—which is generally a combing wire spirally mounted on the cylindrical surface of the opening roller 4—and are peeled off by the difference in flow speed between air streams in a fiber-peeling region where the opening roller 4 becomes contiguous with a fiber outlet channel 7. The channel 7 has one end communicated with atmospheric air outside of the casing 1 and the other end directed into the interior of a spinning rotor 6 defining a fiber twisting region, into which the peeled fibers are fed through the channel 7 to be twisted into a yarn in a known manner.

Figure 2:
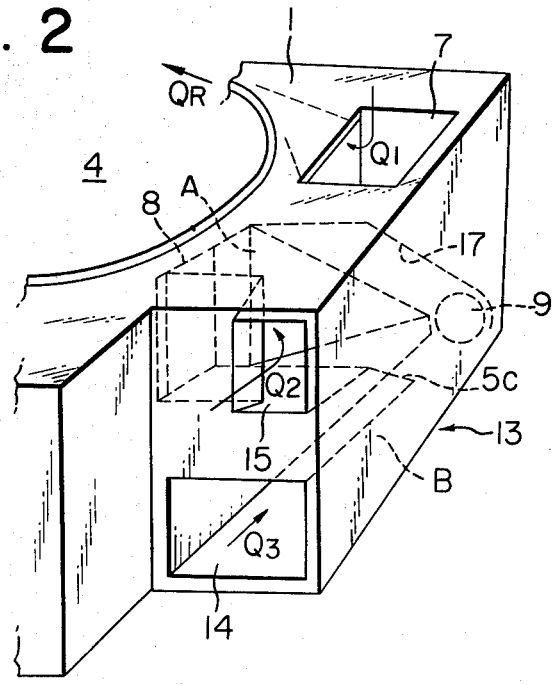
FIG. 2 is a fragmental perspective view showing essential parts of the dust removing mechanism shown in FIG. 1.
Figure 3:
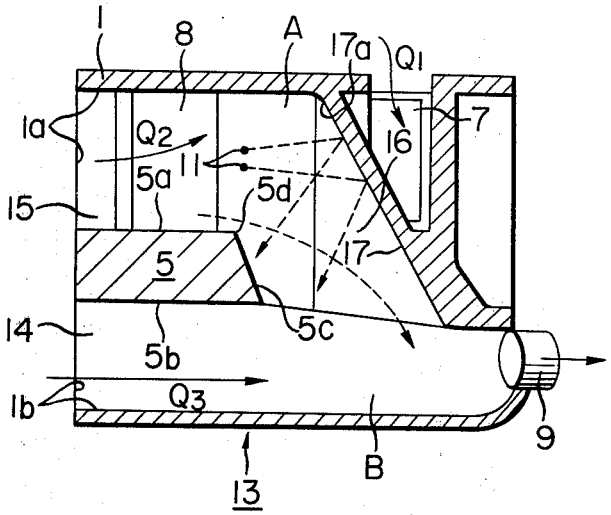
FIG. 3 is a transverse section through the dust removing mechanism of FIG. 2.

In such a spinning unit, the dust removing mechanism of the present invention is incorporated as shown in FIGS. 1 to 3. This mechanism comprises a dust removing chamber 13 having a dust removing opening 8 formed in the inner cylindrical surface of the casing 1 to allow the dust removed from the individual fibers to be ejected through the opening 8 into the dust removing chamber 13. A first air inlet 15 is formed in the outer surface of the casing 1 at a position relatively close to the opening 8 to generate an auxiliary air stream $Q_2$ flowing toward and into the opening 8, and means is provided for generating a dust discharging air stream $Q_3$. The generating means comprises a second air inlet 14 formed in the outer surface of the casing 1 at a position relatively close to the first air inlet 15, and an air outlet or suction opening 9 formed in the outer surface of the casing 1 opposite to the second air inlet 14. As stated in the introductory part of this specification, the dust removing mechanism comprising the afore-mentioned dust removing chamber 13 should be designed with due consideration to the possible problems that the dust ejected at the dust discharge opening 8 may stay in the region close to the dust discharge opening 8; that the dust discharge opening 8 may be adversely affected by the dust discharging air stream $Q_3$; and that the dust once removed may be moved back into the dust discharge opening 8.

In order to overcome these problems, the afore-mentioned co-pending application teaches the division of the dust discharge chamber 13 by a partition wall 5 into a dust separating zone A including the dust removing opening 8, and a dust discharge zone B including said means 9, 14 for generating the substantially linear, dust discharging air stream $Q_3$. However, because of the wedge-shape configuration of the partition wall 5, the dust removing mechanism of said co-pending application is not entirely successful in overcoming the aforementioned disadvantages.

According to this invention, as shown in FIGS. 1 to 3, an upper surface 5*a* of the partition wall 5 defining the zone A in cooperation with the casing wall 1*a* extends horizontally inward from the bottom of the first air inlet 15 toward the air outlet 9, and a lower surface 5*b* of the partition wall 5 defining the zone B in cooperation with the casing wall 1*b* extends horizontally inward from the top of the second air inlet 14 toward the air outlet 9, the inner ends of the upper and lower surfaces 5*a* and 5*b* being connected together by a surface 5*c* which is inclined downwardly toward the air outlet 9. Thus, it will be understood that the outer end edges of the upper and lower surfaces 5*a* and 5*b* of the partition wall 5 define, respectively, the width of the first and second air inlets 15 and 14, thereby determining the intensity of the auxiliary air stream $Q_2$ flowing toward and into the dust removing opening 8, and determining the intensity of the dust discharging air stream $Q_3$ flowing through the dust discharging zone B. In the embodiment shown in FIGS. 1 to 3, while the lower surface 5*b* of the partition wall 5 is shown extending in a horizontal plane which includes or is parallel to an end surface of the opening roller 4, it may be inclined downwardly toward the air outlet 9. In this manner, that a more linear air stream can be generated in the zone B, thus further reducing residence of the dust discharging air stream in the zone B and/or formation of eddies in the zone B.

Between the zones A and B, there is a communicating passage 16 into which the inclined surface 5*c* of the partition wall 5 faces. The details of the inclined surface 5*c* will be described hereinafter.

The casing wall on the downstream side of the dust removing zone A is formed as an inclined wall 17 so that dust particles 11 (FIG. 3) ejected from the dust removing opening 8 are bounced towards the communicating passage 16 or the inclined surface 5*c*. Since this inclined wall 17 is becomes closer to the dust removing opening 8 as it becomes further away from the communicating passage 16, the influence of the dust dust discharging air stream $Q_3$ is diminished, and therefore the residence of the air stream or formation of swirls is substantially eliminated, and the accumulation of dust is prevented. An inclination angle $\alpha$ (FIG. 4) of the inclined wall 17 with respect to the axis of rotation of the opening roller 4 is made equal to or larger than an inclination angle $\beta$ of the inclined surface 5*c* with respect to the axis of rotation of the opening roller 4, so that dust particles 11 which impact against the inclined surface 5*c* after having bounced off the inclined wall 17, are directed towards the dust discharge zone B and the air suction opening 9. Thus, dust particles 11 deflected by the inclined surface 5*c* are always be directed in the desired direction away from the discharge opening 8.

Additionally, according to the present invention, a vertical line 5*d* extending through the commencement of the inclined surface 5*c* is positioned in relation with a line 17*a* extending through the commencement of inclined wall 17 such that any dust particles striking against the inclined wall 17 at a position closely adjacent the commencement thereof are directed toward the inclined surface 5*c*. More specifically, in FIGS. 3 and 4, assuming that a dust particle is directed toward the commencement line 17*a* of the inclined wall 17 at an angle of $\gamma$, of about 2 to 5 degrees with respect to the horizontal plane, determined ependent on a spiral configuration of the combing wire wound around the cylindrical surface of the opening, and that the dust bounces off the line wall 17 at an angle of $\omega$ with respect to the vertical line 7*a*, then the following equation can be obtained:

$$\omega = 90° - 2\alpha + \gamma$$

provided that the angles of incidence and deflection of the dust with respect to a normal to the inclined wall 17 are equal to each other. Therefore, the position of a dust particle at a given time after it has bounced off the wall 17 at the position of the vertical line 17*a* can be expressed by $$x = y \tan \omega = y \tan (90° - 2\alpha + \gamma)$$

wherein x and y respectively represent horizontal and vertical distances to which the dust is present at the given time. As will be apparent from the above expression, in order to cause the dust particle to strike against the inclined surface 5*c*, it is required that at the time when the dust particle travels a distance d (substantially equal to the vertical length of the dust removing opening 8) in the vertical direction, it must travel a horizontal distance x which is less than a horizontal distance a between the vertical lines 5*d* and 17*a*. That is, the vertical line 5*d* should be positioned with respect to the vertical line 17*a* so as to fulfil the following inequality:

$$a > d \tan (90° - 2\alpha + \gamma)$$

In the case of $$a \leqq d \tan (90° - 2\alpha + \gamma)$$

there is a fear that a dust particle bouncing off the wall portion adjacent to the vertical line 17*a* will be directed toward the upper surface 5*a* of the partition wall 5, causing the dust to be moved back into the dust removing opening 8.

Figure 4:
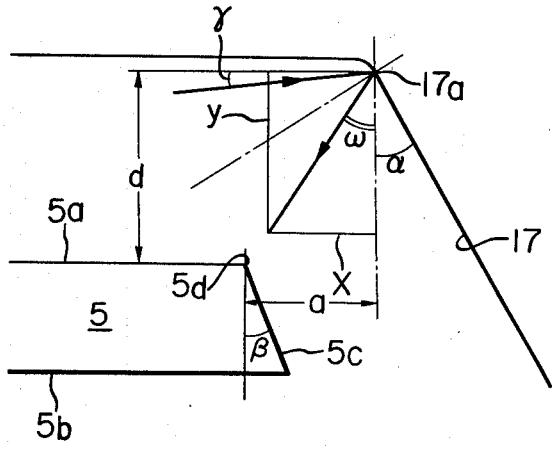
FIG. 4 is a diagrammatic view explaining a function of a partition plate constructed according to this invention.

Regarding the angle $\gamma$, it is stated that where the combing wire is wound as a left hand screw, the dust flying off the dust removing opening 8 is subject to a force in a direction causing it to be fed toward the line 17*a* in a manner shown in FIG. 4. However, where the combing wire is wound as a right hand screw, the dust is thrown in the downward direction and there is little possibility that the dust bouncing off the inclined wall 17 is directed toward the upper surface 5*a* of the partition wall 5.

The following Table shows the results of experimental tests for spinning units I and II respectively employing the dust removing mechanism according to the inventions in the afore-mentioned co-pending application and the present application. From this Table, it will be readily understood that the spinning unit II employing the dust removing mechanism according to this invention exhibits a more greater performance of dust removal than that of the spinning units I in the co-pending application.

| Sliver in Service | Spinning Unit I | | | Spinning Unit II | | |
|---|---|---|---|---|---|---|
| | Cheese Weight (gr.) | Rate of Dust Removal (%) | Dust Amount Collected in Rotor* | Cheese Weight (gr.) | Rate of Dust Removal (%) | Dust Amount Collected in Rotor* |
| 300 gr./6 yds | 349 | 3.53 | 253 mg/Kg Yarn<br>88.4 mg/Cheese | 360 | 3.66 | 120 mg/Kg Yarn<br>43.1 mg/Cheese |
| | | | | 346 | 3.65 | 114 mg/Kg Yarn<br>39.4 mg/Cheese |
| 420 gr./6 yds (passed twice Drawing Frame) | 345 | 1.75 | 80 mg/Kg Yarn<br>27.5 mg/Cheese | 417 | 2.13 | 45 mg/Kg Yarn<br>18.9 mg/Cheese |
| | 339 | 1.82 | 104 mg/Kg Yarn<br>35.2 mg/Cheese | 342 | 2.04 | 30 mg/Kg Yarn<br>10.4 mg/Cheese |
| | | | | 319 | 1.69 | 58 mg/Kg Yarn<br>18.4 mg/Cheese |

*Rotation rate = 60,000 r.p.m.;
Rotation rate of opening roller = 7,000 r.p.m.;
Count of formed yarn, Ne = $10^5$;
Twist constant = 5.0

Different modifications of this invention are shown in FIGS. 5 to 7, from which it can be understood that the first air inlet 15 may be provided in the upper surface of the casing 1 at a position side by side with the dust removing opening 8 (FIG. 5) or at a position on the downstream side of the dust removing opening 8 (FIG. 7); and that the lower surface 5*b* of the partition wall 5 may be inclined downward toward the air outlet 9 (FIG. 6).

In operation, the opened fibers carried by the opening roller 4 have a tendency to fly off, along with the dust, from the roller 4 due to the centrifugal force acting thereon when they arrive at the dust removing opening 8. However, the auxiliary air stream $Q_2$ directed through the first air inlet 15 to the opening 8 is produced by both the subatmospheric pressure inside of the spinning rotor 6 and the air sucking action of the roller 4 owing to the rotation thereof. This air stream $Q_2$ has a considerable intensity and acts on the dust in a direction substantially at a right angle to the locus of the dust 11 (FIG. 1) and on the fibers flying in the tangential direction of the opening roller 4. Accordingly, the free motion of the dust 11 having a larger mass than the fibers overcomes the force by the auxiliary air stream $Q_2$ and the dust 11 is allowed to fly into the dust separating zone A, but the free motion of the fibers is blocked by the force of the auxiliary air stream $Q_2$ and delivery of the fibers by the opening roller 4 is continued.

Some of the dust 11 overcoming the auxiliary air stream $Q_2$ is gradually reduced in speed and directly enters the intermediate passage 16 and then it is discharged through the air outlet 9 by its being entrained on the dust discharging air stream $Q_3$ flowing through the dust discharging zone B. However, the majority of the dust particles impinge against the inclined wall 17 due to the large kinetic energy thereof, and bounce into the intermediate passage 16. The majority of the bouncing dust particles under the influence of the air stream $Q_3$, while the remaining particles impinge against and bounce off the inclined surface 5*c* of the partition wall 5. Therefore, they are reduced in speed and introduced into the intermediate passage 16. Since the angle $\alpha$ of inclination of the casing wall 17 is equal to or larger than the angle $\beta$ of inclination of the partition wall's surface 5*c*, even the dust repeatedly and alternatively impinging against the inclined walls 5*c* and 17 is always be directed toward the intermediate passage 16, but not the dust removing opening 8. Moreover, because of the afore-mentioned positional relationship between the start lines 5*d* and 17*a* of the inclined walls, the dust particles impinging against the inclined wall 17 at the position adjacent to the vertical line 17*a* are directed positively towards the inclined surface 5*c* of the partition wall 5. Thus, it will be understood that in the dust removing mechanism according to this invention, there occurs no problem that the dust once removed through the dust removing opening moves back into the opening region.

The relationship between air streams will now be discussed below. Even if the dust discharging air stream $Q_3$ has a considerably high velocity, it has no influence on the dust removing opening 8 because of the presence of the partition plate 5. Particularly, since the lower surface 5*b* of the partition plate 5 promotes the generation of a linear, dust discharging air stream $Q_3$, the introduction of air stream from the dust separating zone A through the intermediate passage 16 into the dust discharge promoting zone B is remarkably reduced. Accordingly, there occurs no air stream which will adversely affect the auxiliary air stream $Q_2$. More specifically, the subatmospheric pressure in the spinning rotor 6 produces a very high intensity of air stream $Q_R$ (FIG. 2) in cooperation with the rotation of the spinning roller 4 and this air stream $Q_R$ results in the auxiliary air stream $Q_2$ and the flow-in air stream $Q_1$ from the fiber outlet channel 7, but the intensity of the auxiliary air stream $Q_2$ is still much higher than that of the above-mentioned air stream flowing into the zone B through the intermediate passage 16. This weak air stream flowing into the zone B through the intermediate passage 16 is rather preferred in that the dust, which is ejected from the dust removing opening 8 and is reduced in speed thereby to tend to stay in the vicinity of the intermediate passage 16, can be drawn up to the dust discharge promoting zone B by the action of this weak air stream.

As will be apparent from the foregoing, the dust 11 ejected through the dust removing opening 8 is not allowed to stay in the dust separating zone A, but instead is completely introduced into the dust discharge promoting zone B by the actions of the inclined wall 17 and the partition plate's inclined surface 5c. Also in this zone B, the dust 11 is allowed to have no room to stay therein, and, by the action of the linear air stream $Q_3$ is completely discharged through the air suction opening 9.

In the dust removing mechanism according to this invention, the existence of the partition plate 5, which partitions the dust removing chamber 13 into the dust separating zone A and dust discharge promoting zone B connected together by the intermediate passage 16, is very significant. Particularly, the inclined extremity 5c of the partition plate 5 extends downstream of the dust removing opening 8 with respect to the direction of rotation of the opening roller 4 so as to isolate the dust removing opening 8 from the linear air stream $Q_3$ and to define the intermediate passage 16, communicating with the dust discharge promoting zone B, in cooperation with the inclined wall 17 of the casing 1. Thus, the dust can be completely introduced into the dust discharge promoting zone B. Moreover, the lower surface 5b of the partition plate 5 is very effective for the formation of a linear passage for the air stream $Q_3$. As a result, the flow rate from the dust separating zone A into the dust discharge promoting zone B can be reduced to a desired level, which has no influence on the auxiliary air stream $Q_2$ flowing toward and into the dust removing opening.

By virtue of provision of the partition plate 5 having the above-mentioned functions, the dust separating zone A can be disposed very contiguously to the dust discharge promoting zone B. Because of this, the dust removing chamber 13 can be made very compact and the space can be utilized very effectively.

Although various specific embodiments have been described above, it will be readily understood by those skilled in the art that various rearrangements of parts and modifications of parts may be accomplished without departing from the spirit and scope of the invention as defined in the appended claims. For example, the partition plate 5 per se may be slightly inclined downward toward the side wall of the dust discharge promoting zone B remote from the dust removing opening 8.

What we claim is:

1. In an open-end spinning unit including a casing having a cylindrical space, a cylindrical opening roller rotatably disposed within said space to open a sliver into individual fibers and deliver the opened fibers into a twisting region, and a dust removing mechanism incorporated in said spinning unit and having a dust removing chamber to receive dust removed from the fibers and discharge it out of said dust removing chamber, said dust removing mechanism comprising a dust removing opening provided in said casing so as to communicate with both said cylindrical space and said dust removing chamber, means partitioning said dust removing chamber into a dust separating zone and a dust discharge promoting zone connected together at a position downstream of said dust removing opening with respect to a direction of rotation of said opening roller, a first and a second air inlet provided in said casing so as to communicate with said dust removing chamber, and an air suction opening provided in said casing so as to communicate with said dust removing chamber, said dust separating zone being in communication with both said dust removing opening and said first air inlet to allow an auxiliary air stream flowing toward and into said dust removing opening to be generated in said dust separating zone, said dust discharge promoting zone being in communication with both said second air inlet and said air suction opening to allow a substantially linear, dust discharging air stream to be generated in said dust discharge promoting zone, said casing having an inclined inner wall spaced from said partitioning means and inclined at a predetermined angle with respect to an axis of said opening roller; the improvement comprising said partitioning means having an inclined end wall surface defining an intermediate passage in conjunction with said inclined inner wall of said casing and which is inclined with respect to the axis of said opening roller at a predetermined angle smaller than said predetermined angle of said inclined inner wall, whereby dust in said dust separating zone is introduced through said intermediate passage into said dust discharge promoting zone.

2. The dust removing mechanism according to claim 1, wherein a vertical line from which the inclination of said inclined wall of said casing starts is arranged in specific positional relation with respect to a vertical line from which the inclination of said inclined end wall surface of said partitioning means starts, said relation being expressed by;

$$a > d \tan (90° - 2\alpha + \gamma)$$

wherein a and d respectively represent a horizontal and a vertical distance between the vertical lines, $\alpha$ represents said first predetermined angle, and $\gamma$ represents an angle at which the dust strikes against said inclined wall of said casing at a position adjacent to the inclination start line thereof.

3. The dust removing mechanism according to claim 1, wherein said partitioning means includes an upper surface horizontally extending inward from the bottom of said first air inlet, and a lower surface extending inward from the top of said second air inlet, inward ends of said upper and lower surfaces being connected together by said inclined end wall surface.

4. The dust removing mechanism according to claim 3, wherein said lower surface is inclined downwardly toward said air suction opening.

5. The dust removing mechanism according to claim 3, wherein said lower surface extends horizontally.

6. The dust removing mechanism according to claim 3, wherein said upper surface extends inward to a position adjacent to a downstream end of said dust removing opening.

7. The dust removing mechanism according to claim 1, wherein said dust discharge promoting zone is converged toward said air suction opening.

8. The dust removing mechanism according to claim 1, wherein said first air inlet is provided upstream of said dust removing opening with respect to the direction of rotation of said opening roller.

9. The dust removing mechanism according to claim 8, wherein said first air inlet is provided in a side wall surface of said casing extending in parallel to the axis of said opening roller.

10. The dust removing mechanism according to claim 8, wherein said first air inlet is provided in an upper wall surface of said casing extending perpendicular to the axis of said opening roller.

* * * * *